US009840985B2

(12) United States Patent
Martin et al.

(10) Patent No.: US 9,840,985 B2
(45) Date of Patent: Dec. 12, 2017

(54) FUEL VAPOR LINE DIAGNOSTICS

(71) Applicant: Ford Global Technologies, LLC, Dearborn, MI (US)

(72) Inventors: Douglas Raymond Martin, Canton, MI (US); Aed M. Dudar, Canton, MI (US); Robert Roy Jentz, Westland, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 133 days.

(21) Appl. No.: 14/922,718

(22) Filed: Oct. 26, 2015

(65) Prior Publication Data

US 2017/0114744 A1 Apr. 27, 2017

(51) Int. Cl.

| | |
|---|---|
| ***F02M 25/08*** | (2006.01) |
| ***F02D 41/22*** | (2006.01) |
| ***F02M 65/00*** | (2006.01) |
| ***F02D 41/00*** | (2006.01) |

(52) U.S. Cl.

CPC ..... *F02M 25/0818* (2013.01); *F02D 41/0077* (2013.01); *F02D 41/22* (2013.01); *F02M 65/006* (2013.01); *F02D 2041/225* (2013.01)

(58) Field of Classification Search

CPC .. F02M 25/0818; F02M 65/006; F02D 41/22; F02D 41/0077; F02D 2041/225

USPC ..... 123/519

See application file for complete search history.

(56) References Cited

U.S. PATENT DOCUMENTS

| | | | | |
|---|---|---|---|---|
| 5,146,902 | A | 9/1992 | Cook et al. | |
| 5,477,836 | A | 12/1995 | Hyodo et al. | |
| 5,495,749 | A | 3/1996 | Dawson et al. | |
| 6,036,456 | A * | 3/2000 | Peters | F02M 25/0836 417/423.14 |
| 6,113,151 | A | 9/2000 | Beans | |
| 7,878,046 | B2 | 2/2011 | Bolt et al. | |
| 9,026,345 | B2 | 5/2015 | Dudar et al. | |
| 2001/0029933 | A1 * | 10/2001 | Fabre | F02M 25/0809 123/520 |
| 2004/0112341 | A1 * | 6/2004 | Mashimo | F02M 25/0809 123/520 |
| 2004/0226530 | A1 * | 11/2004 | Kojima | F02D 41/006 123/179.3 |
| 2013/0032127 | A1 * | 2/2013 | Jentz | F02N 11/003 123/520 |
| 2015/0083087 | A1 | 3/2015 | Pearce et al. | |

* cited by examiner

*Primary Examiner* — Mahmoud Gimie

(74) *Attorney, Agent, or Firm* — James Dottavio; McCoy Russell LLP

(57) ABSTRACT

Methods and systems are provided for diagnosing fuel vapor leaks due to un-latching of quick connectors in interfaces of a fuel vapor system. In one example, a method may include using positive pressure generated in the intake manifold by reverse rotation of the engine unfueled, to detect un-latching of quick connectors in the fuel vapor system. After the positive pressure test, a negative pressure test is performed on the fuel vapor system to confirm any un-latching of quick connectors.

19 Claims, 6 Drawing Sheets

FUEL VAPOR LINE DIAGNOSTICS

FIELD

The present description relates generally to methods and systems for diagnosing fuel vapor leaks due to disconnections in interfaces of a fuel vapor line.

BACKGROUND/SUMMARY

Vehicles may be fitted with evaporative emission control (EVAP) systems to reduce the release of fuel vapors to the atmosphere. For example, vaporized hydrocarbons (HCs) from a fuel tank may be stored in a fuel vapor canister packed with an adsorbent which adsorbs and stores the fuel vapors. At a later time, when the engine is in operation, the evaporative emission control system allows the fuel vapors to be purged into the engine intake manifold from the fuel vapor canister. The fuel vapors are then consumed during combustion. Quick connectors (also called quick connects or snap fit connectors) may be used to couple the various fluid-carrying conduits and components (such as valves) of the EVAP system. The connectors may be shaped and structured to be closed in a single uniaxial movement which facilitates automated assembly as well as part servicing. In addition, the simple design of the connector makes it inexpensive to manufacture.

During certain conditions, the EVAP system may be monitored to identify breaches that can result in unwanted fuel vapor leaks. As an example, leaks can occur at the interfaces of the various conduits and valves of the EVAP system, such as at the locations where the quick connectors are coupled to the conduits and valves. One example approach for verifying EVAP system integrity includes application of negative pressure to the EVAP system and monitoring a subsequent rise in pressure. The presence of a leak, such as due to disconnection of a connector, may be inferred based on a faster than expected rise in pressure following the application of negative pressure. Another example approach for verifying that a quick connect is latched is shown by Beans in U.S. Pat. No. 6,113,151. Therein, following attachment of a connector to a fluid conduit, a sealing interface between the conduit and the connector is tested by application of a positive pressure from a high pressure source.

However, the inventors herein have recognized potential issues with such systems. As one example, there may be situations where the connector remains unlatched and a leak test is passed. For example, leaks may occur in the EVAP and fuel system (herein together termed fuel vapor system) due to the connector being snapped in but not locked. If the connector is inserted but not locked, the connector may seal momentarily and pass the leak test when the negative pressure is applied since the testing is done in static vehicle conditions while a vehicle engine is idling. However, when the vehicle goes on the road, vibration and surface feedback can cause the connector to pop open. The need for a dedicated pressure source for detection of an unlatched connector adds component cost and complexity. Further, the negative pressure from a vacuum-based leak test may pull in the connector and maintain the loose seal unlatched despite the leak test being passed. As such, this can result in earlier than expected warranty issues for the EVAP system. In addition, the vehicle may be emissions non-compliant.

In one example, the issues described above may be addressed by a method for detecting unlatching of a fuel vapor line connector, comprising: reverse rotating an engine unfueled while opening a purge valve to apply positive pressure from an intake manifold on a fuel vapor system; and indicating disconnection of a connector coupled to a fuel vapor conduit of the fuel vapor system based on a pressure response following the application of positive pressure. The application of positive pressure to the fuel vapor system is followed by monitoring pressure in the system. An unexpected drop in the positive pressure may indicate a quick connector disconnection or other leak in the system. The positive pressure test may be following by an application of negative pressure, and the quick connector disconnection may be confirmed based on the pressure response following the application of negative pressure. In this way, leaks in a fuel vapor system due to unlatching of a connector can be identified more accurately and addressed in a timely manner.

As one example, at an assembly facility or a service station, a service tool may be coupled to a vehicle and the vehicle may be shifted to service mode. Positive pressure generated at the engine may then be applied to the fuel vapor system of the vehicle to detect unlatching of any quick connectors coupled to different conduits and components of the fuel vapor system. The positive pressure unlatches any quick connectors that may have been loosely attached, but not locked in place. A faster/higher than expected drop in intake manifold pressure is used to infer the presence of a leak in the fuel vapor system generated by the disconnection or un-latching of a quick connector. Un-latching of quick connectors may cause large leaks in the fuel vapor system which may take only a few seconds to be detected by application and monitoring of positive pressure. The positive pressure applied for the leak test may be generated by spinning the vehicle engine, unfueled, in reverse (opposite to the direction of engine rotation during normal vehicle operation), using an electric machine, such as an electric motor. Alternatively, a fuel tank pump may be operated to warm up and agitate fuel, thereby generating positive fuel vapor pressure. Further still, positive pressure may be generated by operating an electric pump of the engine leak detection system through a reversing circuit. Following the positive pressure test, a negative pressure leak test may also be carried out to confirm the presence of any leaks and unlatched connectors.

In this way, actual and imminent leaks caused by quick connector unlatching in a fuel vapor system may be detected at the end of an assembly line and/or at a service station. The technical effect of diagnosing for leaks by sequentially applying positive pressure followed by negative pressure is that false negative leak results can be reduced. In particular, the technical effect of applying positive pressure to the fuel vapor system first is that loosely attached quick connectors may be fully unlatched, exposing any imminent leaks. As such, loosely attached connectors that may have passed the negative pressure test (due to the vacuum pulling the unlatched connector closer to the conduit) may be fully unlatched due to the positive pressure, ensuring the detection of a leak. By using positive pressure for the leak test generated via the reverse rotation of an unfueled engine, or via the operation of an existing system pump, such as a fuel pump, the need for a dedicated pressure source is reduced, providing component and cost reduction benefits. By improving the diagnostics for loosely fitted quick connectors, system integrity can be ensured and emissions compliance may be improved. In addition, early warranty issues for the EVAP system may be avoided.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
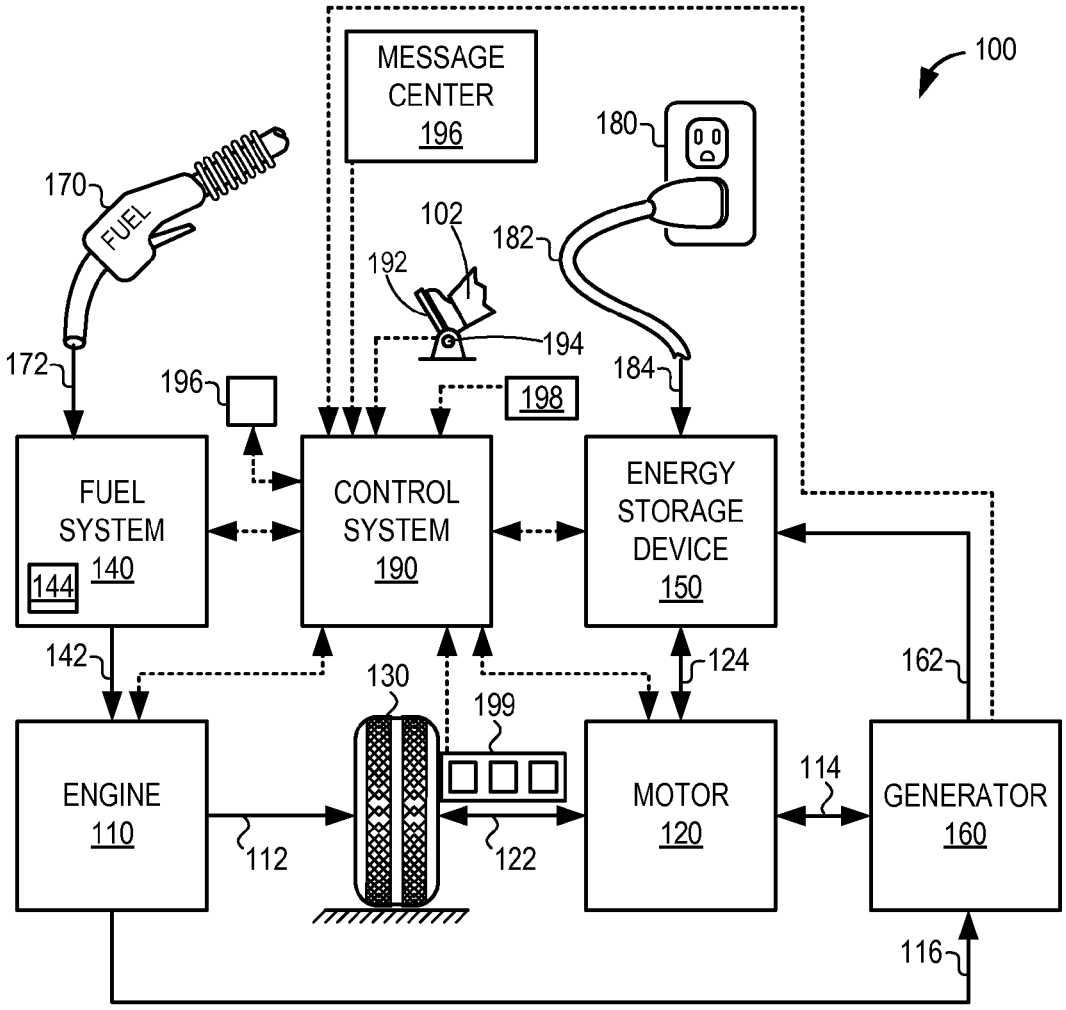
FIG. 1 shows an example hybrid vehicle propulsion system.
Figure 2:
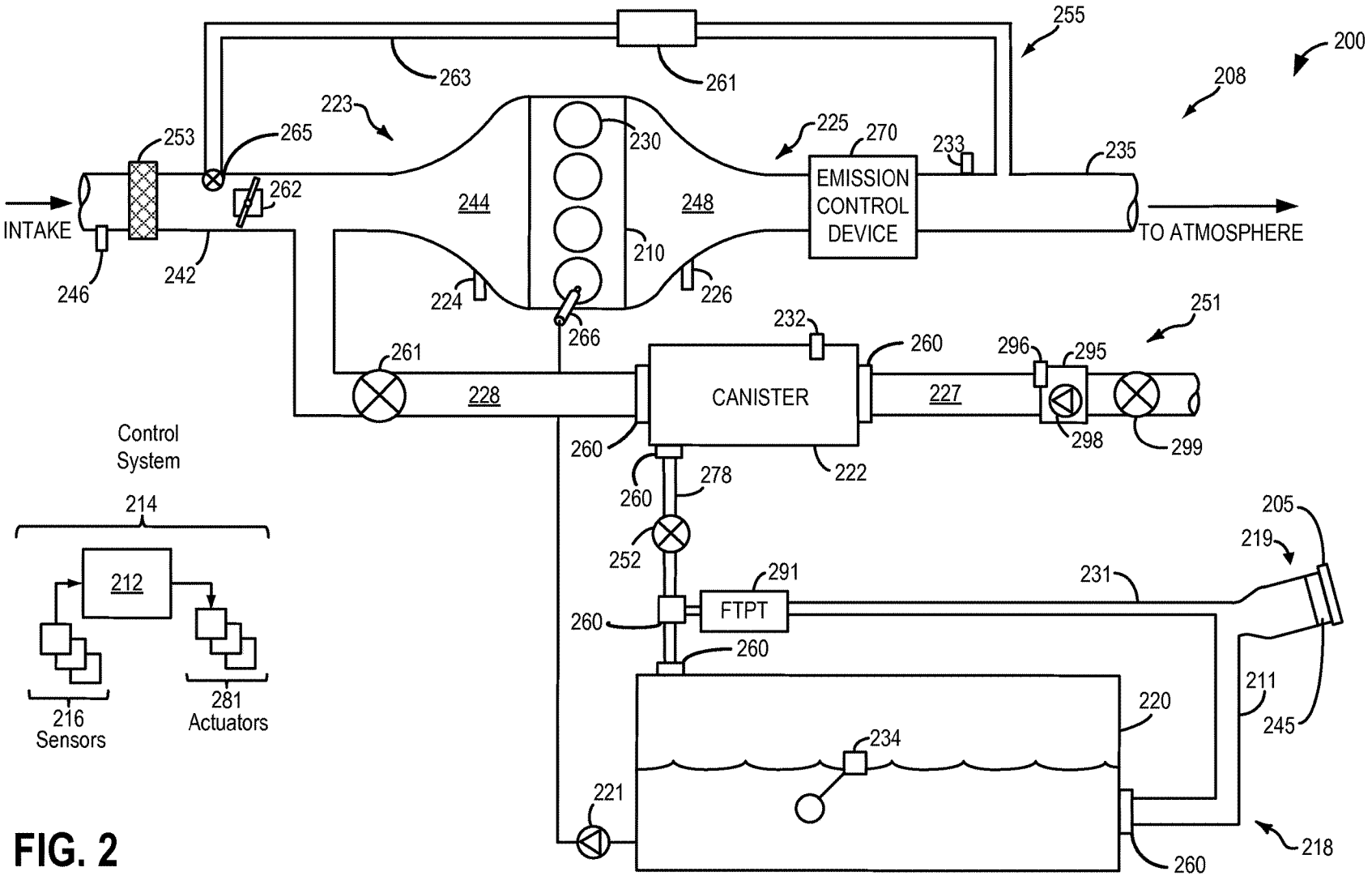
FIG. 2 shows an example vehicle engine system including a couple EGR system, fuel system and an evaporative emissions system.

The following description relates to methods and systems for diagnosing fuel vapor leaks due to unlatching of a quick connector coupled in a fuel vapor line. A hybrid vehicle propulsion system configured to operate with one or both of motor torque from an electric motor and engine torque from an internal combustion engine is shown in FIG. 1. The engine system of the hybrid vehicle, as shown in FIG. 2, may include a fuel system, an evaporative emissions control (EVAP) system, and an exhaust gas recirculation (EGR) system. Positive and negative pressure may be successively applied to the fuel vapor system for diagnosing system leaks caused by disconnection of the quick connector. An engine controller may be configured to perform a control routine, such as the example routine of FIGS. 3 and 4, to determine the operation mode of the vehicle, and selectively diagnose quick connector un-latching in a service mode of operation. Disconnection may be diagnosed based on a rapid drop in intake manifold pressure following the application of a positive pressure generated at the engine (FIG. 5), and a rapid rise in manifold pressure following the subsequent application of a negative pressure generated at the engine. An example diagnosis is shown with reference to FIG. 6. In this way, the connection integrity of quick connectors coupled in a fuel vapor system can be diagnosed more accurately and reliably.

Regarding terminology, as used herein, a vacuum may also be termed "negative pressure". Both vacuum and negative pressure refer to a pressure lower than atmospheric pressure. Further, an increase in vacuum may cause a higher level of vacuum as the vacuum approaches absolute zero pressure or perfect vacuum. When vacuum decreases, a level of vacuum reduces as the vacuum approaches atmospheric pressure level. In other words, a lower amount of vacuum indicates a shallow level of vacuum. Said another way, lower vacuum may be a negative pressure that is closer to atmospheric pressure than a higher (or deeper) level of vacuum. A pressure may be termed positive pressure when the pressure is higher than atmospheric (or barometric) pressure.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV) or simply a hybrid vehicle. Alternatively, the propulsion system 100 depicted herein may be termed a plug-in hybrid electric vehicle (PHEV).

Vehicle propulsion system 100 may be operated in a variety of different operational modes depending on operating conditions encountered by the vehicle propulsion system. Some of these modes may enable engine 110 to be maintained in an off state (e.g., set to a deactivated state) where combustion of fuel at the engine is discontinued. For example, under select operating conditions, motor 120 may propel the vehicle via drive wheel 130 as indicated by arrow 122 while engine 110 is deactivated (herein also referred to as an electric mode). Herein, the engine may be shut down to rest while the motor propels vehicle motion.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator operation in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated (herein also referred to as an engine mode). During other operating conditions, both engine 110 and motor 120 may each be operated to propel the vehicle via drive wheel 130 as indicated by arrows 112 and 122, respectively (herein also referred to as an assist mode). A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator operation to convert the engine output to electrical energy, where the electrical energy may be stored at energy storage device 150 for later use by the motor.

Fuel system 140 may include one or more fuel tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Thus, liquid fuel may be supplied from fuel tank 144 to engine 110 of the motor vehicle shown in FIG. 1. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

The vehicle propulsion system 100 may also include an ambient temperature/humidity sensor 198 and a roll stability control sensor, such as a lateral and/or longitudinal and/or yaw rate sensor(s) 199. Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

Fuel in fuel tanks of hybrid vehicles may not be used for combustion for substantially long durations (e.g., months) if the hybrid vehicle is operated in an electric mode (e.g., engine-off mode). The hybrid vehicle may be operated in the electric mode for months if the vehicle operator decides to recharge the energy storage device regularly and constantly and if the vehicle is driven largely on surface streets without activating the engine.

FIG. 2 shows a schematic depiction of a vehicle system 200. The vehicle system 200 includes an engine system 208 coupled to a fuel system 218, an evaporative emissions control system 251 and an exhaust gas recirculation system 255. Evaporative emissions control system 251 (also termed, evaporative emissions system 251) includes a fuel vapor container or fuel system canister 222 which may be used to capture and store fuel vapors.

In some examples, vehicle system 200 may be a hybrid electric vehicle system, such as the vehicle propulsion system 100 of FIG. 1. The engine system 208 may include an engine 210 having a plurality of cylinders 230. As such, engine 210 may be to the same as engine 110 of FIG. 1 while control system 214 of FIG. 2 may be the same as control system 190 of FIG. 1. The engine 210 can be rotated in the forward direction using engine torque and/or motor torque for vehicle propulsion during some conditions and rotated in a reverse direction using motor torque for generation of positive pressure for leak detection during other, different conditions, without supplying any torque for vehicle propulsion to vehicle wheels. Specifically, positive pressure may be generated in the intake manifold 244 by reverse rotating the engine 210, unfueled, via electric motor 120 of FIG. 1, and this generated positive pressure may be applied for fuel vapor system diagnostics. The fuel vapor system may comprise the evaporative emissions control system 251 and the fuel system 218. By applying positive pressure from the intake manifold 244 to the fuel vapor system, loosely attached connectors, if any, may be actively unlatched and a leak may be created in the fuel vapor system. A drop in positive manifold pressure, as detected by manifold absolute pressure (MAP) sensor 224, may then be used to infer the presence of a leak in the fuel vapor system. The leak due to the unlatched connector may then be further confirmed by application of a negative pressure (vacuum) to the fuel vapor system. By applying positive pressure first, any loosely coupled quick connector may be completely un-latched, reducing their false passing of negative pressure leak tests. In cases where quick connectors are completely un-latched both positive and negative pressure tests are able to diagnose the un-latching. However, if a quick connector is latched but not completely locked in place, if negative pressure test is carried out before the positive pressure test, false negative leak test results may be caused due to loosely coupled quick connectors becoming temporarily pulled together during vacuum application. In case of application of a negative pressure, a higher than unexpected rise in MAP may be used to infer the presence of a leak in the system due to the unlatched connector. In this way, a disconnected connector in the fuel vapor line may be diagnosed based on the presence of leaks, and a loosely attached connector that may cause imminent leaks in the fuel vapor system can also be detected.

The engine 210 includes an engine intake 223 and an engine exhaust 225. The engine intake 223 includes a throttle 262 fluidly coupled to the intake manifold 244. Fresh intake air enters intake passage 242 and flows through air filter 253. Air filter 253 positioned in the intake passage 242 may clean intake air before the intake air is directed to the intake manifold 244. Cleaned intake air exiting the air filter 253 may stream past throttle 262 (also termed intake throttle 262) into intake manifold 244 via intake passage 242. As such, intake throttle 262, when fully opened, may enable a higher level of fluidic communication between intake manifold 244 and intake passage 242 downstream of air filter 253. An amount of intake air provided to the intake manifold 244 may be regulated via throttle 262 based on engine operating conditions. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

All or part of the treated exhaust from emission control 270 may be released into the atmosphere via exhaust conduit 235. Vehicle system 200 includes an exhaust gas recirculation (EGR) system 255 for routing a desired portion (depending on operating conditions) of exhaust gas from the exhaust passage 235 to the intake manifold 244 via an EGR passage 263. The amount of EGR provided may be varied by controller 212 by adjusting an EGR valve 265 in the EGR passage 263. By introducing exhaust gas to the engine 210, the amount of available oxygen for combustion is decreased, thereby reducing combustion flame temperatures and reducing the formation of $NO_x$, for example.

Fuel system 218 may include a fuel tank 220 coupled to a fuel pump system 221. Quick connectors 260 may be used to couple different fuel system components such as the fuel tank 220 to the fuel conduit. Quick connectors 260 may comprise two or more components which may be latched and locked together by a twist-lock mechanism. Each component may have fitting ports for coupling with fuel system components. The fuel pump system 221 may include one or more pumps for pressurizing fuel delivered to the injectors of engine 210, such as the example injector 266. As elaborated herein, during selected conditions, such as during quick connector diagnostic routines, the fuel pump 221 may also be used to generate positive fuel vapor pressure. In one example, pump operation may be used to agitate fuel in the fuel tank, thereby raising the fuel vapor pressure. In another example, engine operation may be used to heat fuel in the fuel tank, thereby raising fuel vapor pressure. Additionally, fuel vapor may be generated in the fuel tank due to ambient heat. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Evaporative emissions control (EVAP) system 251 may include one or more emissions control devices, such as one or more fuel vapor canisters 222 (also termed, canister 222) filled with an appropriate adsorbent. The canisters are configured to temporarily trap fuel vapors (including vaporized hydrocarbons) during fuel tank refilling operations and "running loss" (that is, fuel vaporized during vehicle operation). In one example, the adsorbent used is activated charcoal. Vapors generated in fuel system 218 may be routed to evaporative emissions control system 251, via vapor recovery line 231. Fuel vapors stored in fuel vapor canister 222 may be purged to the engine intake 223 at a later time. Vapor recovery line 231 may be coupled to fuel tank 220 via one or more conduits and may include one or more valves for isolating the fuel tank during certain conditions. Evaporative emissions system 251 may further include a canister ventilation path or vent line 227 which may route gases out of the canister 222 to the atmosphere.

Vent line 227 may allow fresh air to be drawn into canister 222 when purging stored fuel vapors from canister 222 to engine intake 223 via purge line 228 and canister purge valve 261 (also termed, purge valve 261). For example, purge valve 261 may be normally closed but may be opened during certain conditions so that vacuum from engine intake manifold 244 is applied to the fuel vapor canister 222 for purging. During fuel vapor system diagnostics for detection of unlatching of quick connectors, the purge valve 261 may be opened to transfer positive pressure generated by reverse engine rotation, from the intake manifold to the fuel vapor system.

In some examples, the flow of air between canister 222 and the atmosphere may be regulated by a canister vent valve 299 coupled within vent line 227. A fuel tank isolation valve (FTIV) 252 may be positioned between the fuel tank and the fuel vapor canister within conduit 278. FTIV 252 may be a normally closed valve, that when opened, allows for the venting of fuel vapors from fuel tank 220 to canister 222. Fuel vapors may be stored within canister 222 and air, stripped off fuel vapors, may then be vented to atmosphere via vent line 227. Fuel vapors stored in fuel vapor canister 222 may be purged along purge line 228 to engine intake 223 via canister purge valve 261 at a later time when purging conditions exist. As such, FTIV 252 when closed may isolate and seal the fuel tank 220 from the evaporative emissions system 251. It will be noted that certain vehicle systems may not include FTIV 252.

In some examples, recovery line 231 may be coupled to a fuel filler system 219 (or refueling system 219). In some examples, fuel filler system may include a fuel cap 205 for sealing off the fuel filler system from the atmosphere.

Refueling system 219 is coupled to fuel tank 220 via a fuel filler pipe or neck 211. Further, refueling system 219 may include refueling lock 245. In some embodiments, refueling lock 245 may be a fuel cap locking mechanism.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open FTIV 252 while closing canister purge valve (CPV) 261 to direct refueling vapors into canister 222 before venting the air to the atmosphere.

As another example, the fuel system may be operated in a refueling mode (e.g., when fuel tank refueling is requested by a vehicle operator), wherein the controller 212 may open FTIV 252, while maintaining canister purge valve 261 closed, to depressurize the fuel tank before allowing fuel to be added therein. As such, FTIV 252 may be kept open during the refueling operation to allow refueling vapors to be stored in the canister. After refueling is completed, the FTIV may be closed.

As yet another example, the fuel system may be operated in a canister purging mode (e.g., after an emission control device light-off temperature has been attained and with the engine running), wherein the controller 212 may open canister purge valve 261 while closing FTIV 252. Herein, the vacuum generated by the intake manifold of the operating engine may be used to draw fresh air through vent line 227 and through fuel vapor canister 222 to purge the stored fuel vapors into intake manifold 244. In this mode, the purged fuel vapors from the canister are combusted in the engine. The purging may be performed opportunistically, such as when the hybrid vehicle is operated in an engine mode, and/or continued until the stored fuel vapor amount in the canister is below a threshold.

As yet another example, the fuel system may be operated in a quick connector diagnostics mode. Therein positive pressure generated in the engine intake manifold 244 (method of positive pressure generation is elaborated in FIG. 5) may be applied to the fuel vapor system by opening the purge valve 261 and the FTIV 252 for detection of un-latched quick connectors. In this mode, following the application of positive pressure, the drop in pressure in the presence of quick connector un-latching is detected by MAP drop. Subsequent to application of positive pressure, any quick connector un-latching is confirmed by applying negative pressure generated in the engine intake manifold 244 to the fuel vapor system (by opening the purge valve 261 and the FTIV 252). During the generation of the positive and the negative pressure in the engine intake manifold the purge valve is kept closed in order to isolate the engine intake manifold.

Similar to the fuel system 218, quick connectors 260 may be used to couple different components of the EVAP system such as the canister to the fuel line 278, purge line 228 and vent line 227. The quick connectors are latched and locked in place during assembly and/or after a servicing routine is completed (if the connectors were unlatched and unlocked during the servicing routine). If the connector is inserted into the conduit but not locked, the connector may seal momentarily, however, when the vehicle goes on the road, vibration and surface feedback can cause the connector to pop open, resulting in a fuel vapor system leak. If undetected, this can cause engine emissions to increase. As elaborated at FIG. 4, un-latching of quick-connects may be detected at end of assembly line and/or at vehicle service stations by application of positive pressure on the fuel vapor system.

Controller 212 may be included in control system 214. Control system 214 is shown receiving information from a plurality of sensors 216 (various examples of which are described herein) and sending control signals to a plurality of actuators 281 (various examples of which are described herein). As one example, sensors 216 may include manifold absolute pressure (MAP) sensor 224, barometric pressure (BP) sensor 246, exhaust gas sensor 226 located in exhaust manifold 248 upstream of the emission control device, temperature sensor 233, fuel tank pressure sensor 291 (also termed a fuel tank pressure transducer or FTPT), and canister temperature sensor 232.

The MAP sensor 224 may be utilized during fuel vapor system leakage diagnostics, including the detection of an unlatched quick connector in the fuel vapor line. The engine 210 may be rotated in the forward direction using engine torque and/or motor torque for vehicle propulsion. During selected conditions, an electric motor (such as electric motor 120 in FIG. 1) may be used for diagnosis of quick connector un-latching in fuel vapor systems. Therein, the engine 210 is operated in a reverse direction using motor torque for generation of positive pressure for leak detection. Specifically, positive pressure may be generated in the intake manifold 244 by reverse rotating the engine 210, unfueled, via electric motor 120 of FIG. 1, and the generated positive pressure may be applied for fuel vapor system diagnostics. As used herein, the fuel vapor system comprises of the evaporative emissions control system 251 and the fuel system 218. By applying positive pressure from the intake manifold 244 to the fuel vapor system, any loosely attached connectors will be unlatched and a leak is created in the fuel vapor system. A rapid drop in in positive manifold pressure, as detected by manifold absolute pressure (MAP) sensor 224 indicates the unlatching of any connectors in the fuel vapor system. The unlatching is further confirmed by application of a negative pressure (vacuum) to the fuel vapor system. In the case of application of negative pressure, a higher than expected rise in MAP is used to infer the presence of a leak due to unlatching of one or more quick connectors present in the system and a flag may be set accordingly. In this way, uncoupled and/or any loosely attached quick connectors that lead to leaks in the fuel vapor system can be reliably detected.

The present disclosure describes a leak test performed at the end of assembly line or at a service station to detect any imminent leaks that may occur due to unlatching of loosely coupled fuel system quick connectors. Further leak tests may be performed using a negative pressure by an evaporative leak check module (ELCM) 295 communicatively coupled to controller 212. ELCM 295 may be coupled to the evaporative emissions system 251 of vehicle system 200. Further, ELCM 295 may be coupled in vent line 227, between canister 222 and the atmosphere. ELCM 295 may include a pump 298, such as a vacuum pump, for applying negative pressure to the fuel system when administering a leak test. In some embodiments, the pump 298 may be configured to be reversible. In other words, the pump 298 may be configured to apply either a negative pressure or a positive pressure on the evaporative emissions system and/or fuel system. A reversing circuit may be used to reverse polarize the electric connections of the pump 298 to generate positive pressure. ELCM 295 may further include a reference orifice (not shown), a changeover valve (COV) (not shown), and a pressure sensor 296. The COV may be moveable between a first position and a second position. In the first position, air may flow through ELCM 295 via a first flow path. In the second position, air may flow through ELCM 295 via a second flow path. In either the first or second position, pressure sensor 296 may generate a pressure signal reflecting the pressure within ELCM 295. The position of the COV may be controlled by a solenoid via a compression spring. The reference orifice in the ELCM may have a diameter corresponding to the size of a threshold leak to be tested, for example, 0.02". As a reference check, the ELCM may be isolated from the fuel system and evaporative emissions system, and the pump activated to draw a vacuum on the reference orifice. The resulting pressure serves as a reference for leaks of equivalent size. The ELCM can then be coupled to one or both of the fuel system and the evaporative emissions system, and the pump may be activated. If the system(s) is (are) intact, the reference vacuum should be attained. Operation of pump 298 and the solenoid of COV may be controlled via signals received from controller 212.

Following the applying of vacuum (and/or positive pressure) to the evaporative emissions system or fuel system, a change in pressure at the reference orifice (e.g., an absolute change or a rate of change) may be monitored and compared to a threshold. Small leaks in the fuel vapor system may take several seconds to even a few minutes for detection. Based on the comparison, if the change in pressure is higher than a threshold (and/or lower than a threshold for the positive pressure test), fuel vapor system leak may be confirmed.

Other sensors such as pressure, temperature, air/fuel ratio, and composition sensors may be coupled to various locations in the vehicle system 200. As another example, the actuators may include CPV 261, fuel injector 266, throttle 262, FTIV 252, fuel pump 221, and refueling lock 245. The control system 214 may include a controller 212. The controller may receive input data from the various sensors, process the input data, and trigger the actuators in response to the processed input data based on instruction or code programmed therein corresponding to one or more routines. Example control routines are described herein with regard to FIGS. 3, 4 and 5.

The controller 212 receives signals from the various sensors of FIG. 2 and employs the various actuators of FIG. 2 to adjust engine operation based on the received signals and instructions stored on a memory of the controller. For example, adjusting the canister purge valve may include adjusting an actuator of the canister purge valve to adjust a flow rate of fuel vapors there-through. As such, controller 212 may communicate a signal to the actuator (e.g., canister purge valve solenoid) of the canister purge valve based on a desired purge flow rate. Accordingly, the canister purge valve solenoid may be opened (and pulsed) at a specific duty cycle to enable a flow of stored vapors from canister 222 to intake manifold 244 via purge line 228.

Leak detection routines may be intermittently performed by controller 212 on evaporative emissions system 251 and fuel system 218 to confirm that the fuel system is not degraded. In one example, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum.

FIGS. 1 and 2 show example configurations of a vehicle system with different components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example.

Figure 3:
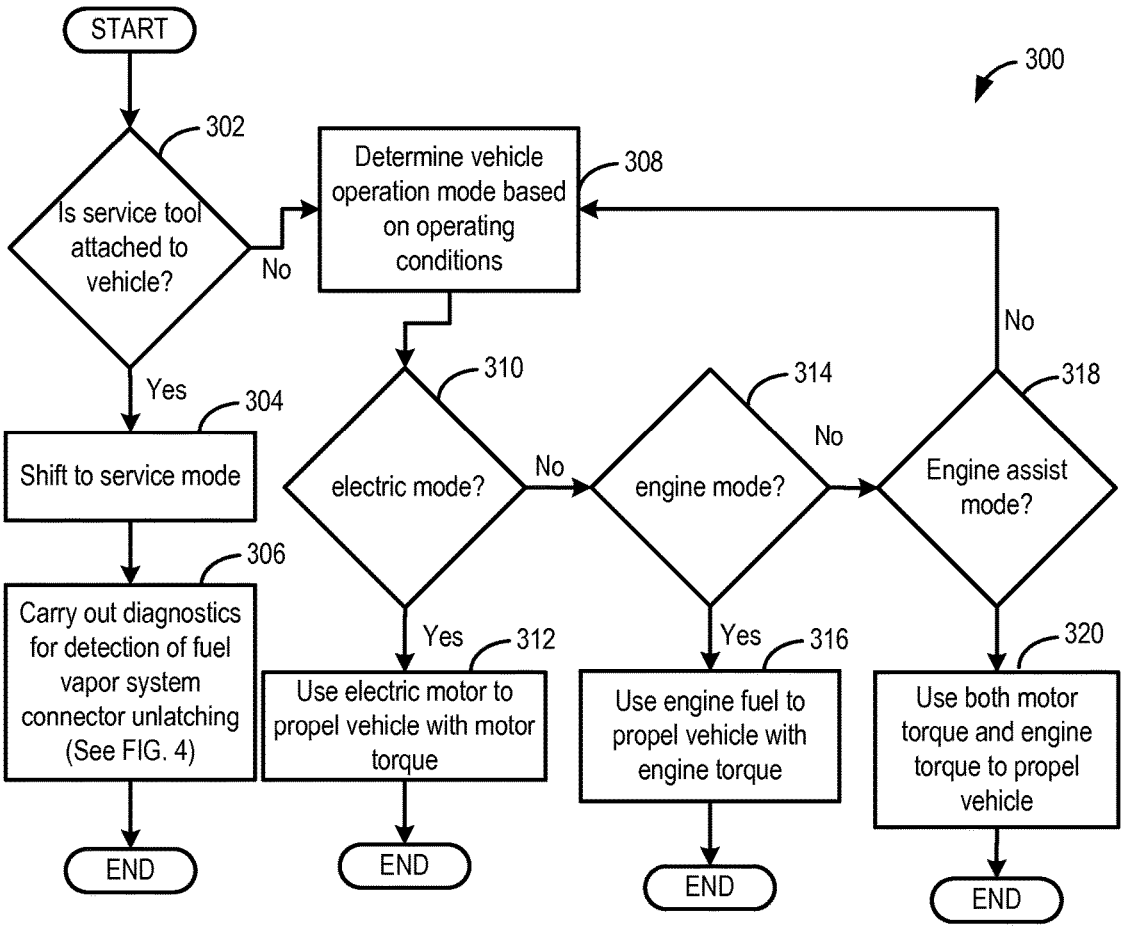
FIG. 3 shows a flow chart illustrating an example method that may be implemented for determining the operation mode of a hybrid vehicle.

FIG. 3 shows an example method 300 for determining the operating mode of the hybrid vehicle based on operating conditions. Instructions for carrying out method 300 and the rest of the methods included herein may be executed by a controller based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below.

At 302, the method determines if a service tool is attached to the vehicle. The service tool may be used at the end of line at an assembly facility or at a service station. For example, the service tool may be attached to the engine by a service technician at the end of the production line to detect any malfunctions and/or degradation of the vehicle system. Such tools may also be used for diagnosis and repair of vehicle system components during vehicle servicing. For example, the service tool may be attached to the engine by the service technician when the vehicle is taken for servicing. If a service tool is attached to the vehicle, at 304, the controller switches the vehicle to a service mode of operation. When in service mode, the vehicle is stationary (wheels are not being propelled) and various diagnostic tests can be carried out in the vehicle system with the engine running or not running.

At 306, in response to the service tool being attached and the vehicle being in the service mode, a diagnostic routine is carried out for the detection of fuel vapor system quick connector un-latching. As elaborated with reference to FIGS. 4 and 5, in order to detect any leaks generated in the fuel vapor system by the un-latching of the a quick connector of the fuel vapor system, positive pressure generated at the engine intake manifold may be applied to the fuel vapor system first. A subsequent rapid drop in intake pressure (such as a faster than expected rate of pressure drop, or a drop in pressure to below a threshold pressure) may indicates a quick connect un-latching in the system. Due to the positive pressure applied, any loosely coupled connectors in the fuel vapor system will get un-latched creating a leak in the system. In this way positive pressure may be used for early detection of imminent leaks due to quick connect un-latching which could have taken place once the vehicle was operational on-road. In order to confirm the un-latching of a quick connector in the fuel vapor system, subsequent to application of positive pressure, negative pressure generated by forward rotation of the engine is applied from the engine manifold to the fuel vapor system. In the presence of a leak caused by an unlatched quick connector, a rapid rise (such as a faster than expected rate of pressure rise, or a rise in pressure to above a threshold pressure) in intake pressure is detected.

In case the vehicle is not attached to a service tool at 308, based on operating conditions the operating mode of the vehicle may be selected. Specifically, the control system may determine whether to operate the vehicle in an electric mode (wherein the vehicle is propelled using energy from operation of the electric motor), in an engine mode (wherein the vehicle is propelled using energy only from fuel combustion in the engine) or in an engine assist mode (wherein the vehicle is propelled using energy from operation of both the engine and the motor). As one example, if the state of charge (SOC) of the on-board energy storage device is higher than a threshold SOC and the torque load is lower than a threshold load, the control system may operate only the motor to propel the vehicle. In another example, if the state of charge (SOC) of the on-board energy storage device is lower than the threshold SOC and the torque load is higher than the threshold, the control system may operate only the engine to propel the vehicle. If the operator requested torque is greater than a second, higher threshold, the control system may operate in the engine assist mode where both the engine and the motor are used to propel the vehicle.

At 310, it may be determined if the vehicle is to be operated in the electric mode. If electric mode conditions are met, the hybrid vehicle may be operated in the electric mode wherein the electric mode includes, at 312, using an electric motor to generate motor torque to propel the vehicle via drive wheels. During vehicle operation in the electric mode, the engine may remain deactivated (that is, not fueled and not spinning).

If the electric mode is not selected, at 314 it may be determined if conditions for operating in the engine mode are met. If yes, operating the hybrid vehicle in the engine mode includes the vehicle drive wheels being propelled using engine torque generated by fuel combustion in the engine. When operating the hybrid vehicle in the engine mode, at 316, the electric motor is disabled and the vehicle is only operated by engine torque. In one embodiment, the electric motor may be further used as a generator when the engine is used to propel the vehicle. During this mode, the motor may be used to convert vehicle kinetic energy during braking to electric energy which may be stored in an energy storing device.

If neither electric mode nor engine mode conditions are selected, it may be determined at 318 if conditions are met for operating the vehicle in an engine assist mode. At 320, the engine is operated in an engine assist mode in which both the electric motor torque and engine torque are utilized for vehicle propulsion during higher load conditions. For engine assist mode, the vehicle may be operated via a parallel or series type vehicle propulsion system as previously described in relation to FIG. 1. Also, during engine assist mode, electric energy may be generated and stored in an energy storing device. In this way different vehicle operating modes are operated based on suitable conditions.

Figure 4:
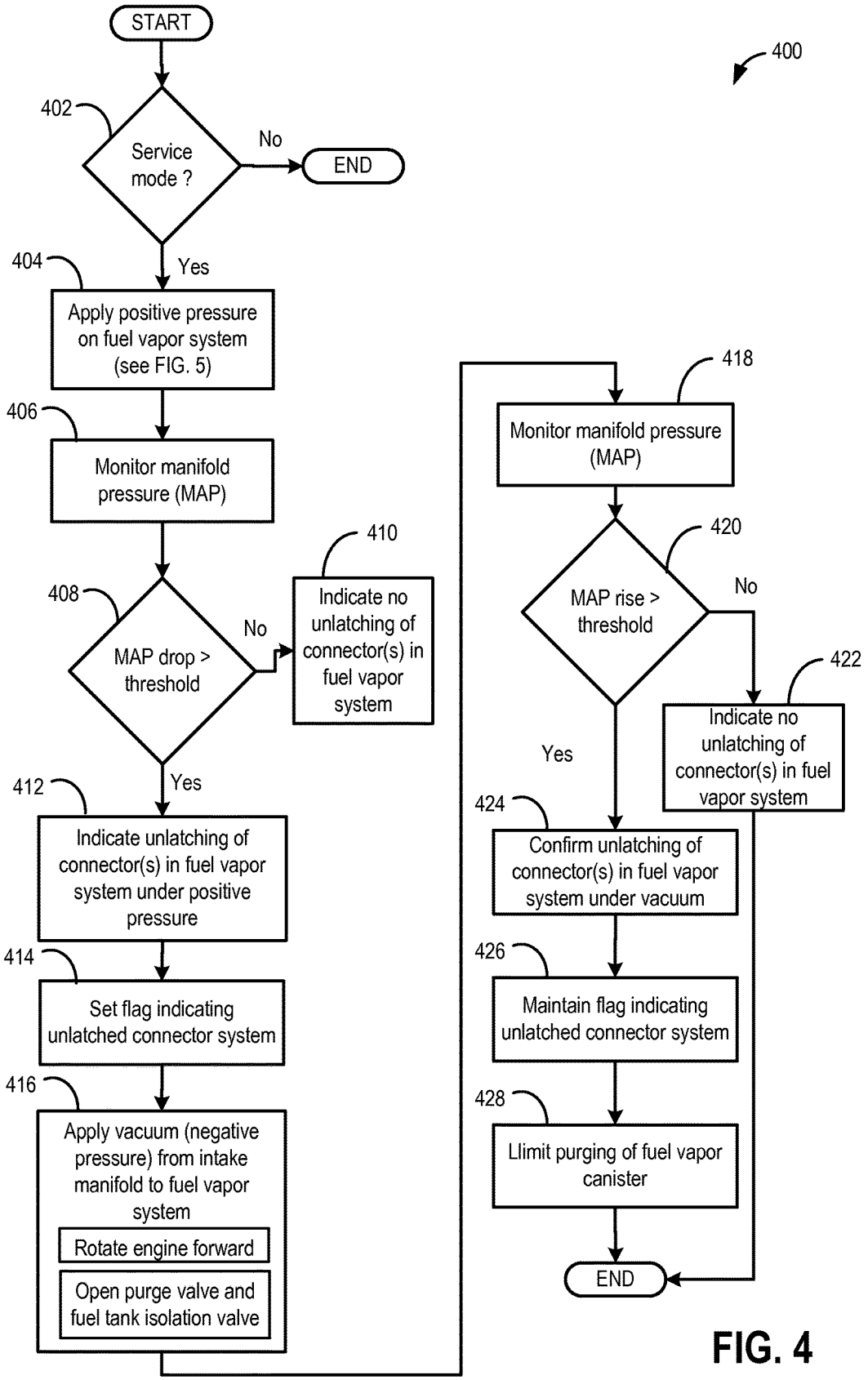
FIG. 4 shows a flow chart illustrating an example method that may be implemented for diagnosing leaks caused by unlatching of a quick connector in a fuel vapor system.

FIG. 4 shows an example routine for the diagnosis of leaks caused by quick connector unlatching in fuel vapor systems using sequential application of positive and (subsequently) negative pressure. At 402, the routine includes determining if the vehicle is in the service mode. In the service mode, a service (diagnostic) tool is coupled to the engine through a port by an operator. During the service mode, the vehicle is stationary and various diagnostics may be run on different engine components with the engine running or not running. Such diagnostics may be carried out at the end of production line or at vehicle service stations. If the vehicle is not in service mode, the routine ends as quick connector diagnostics may not be carried out in any other operational mode.

Once the vehicle is in the service mode with the service tool attached, at 404, positive pressure is applied to the fuel vapor system. Applying positive pressure on the fuel vapor system includes one of reverse rotating the engine unfueled via an electric motor with an intake throttle closed and an EGR valve closed to contain the positive pressure in the intake manifold, operating a fuel tank pump to apply positive fuel vapor pressure, and operating an electric pump of an engine leak detection module with a reversing circuit to apply positive air pressure. Details regarding the generation and application of positive pressure are discussed with relation to FIG. 5.

After the application of positive pressure on the fuel vapor system, at 406 the intake manifold pressure (MAP) is monitored using a MAP sensor (such as the MAP sensor 224 in FIG. 2). The MAP sensor measures the pressure at the intake manifold. During the application and monitoring of positive pressure in the system, the canister purge valve and the fuel tank isolation valve may be maintained in an open position. If there are any loosely coupled quick connectors in the fuel vapor system that are not locked in place, the positive pressure will cause the connectors to un-latch. Such loose quick connectors may have uncoupled when the vehicle travels on the road, creating a leak in the fuel vapor system. By carrying out the diagnostic method by initially applying positive pressure, any such present or imminent leaks due to quick connector un-latching may be detected before the vehicle is on-road. On application of positive pressure to the fuel vapor system, if there is any unlatched quick connector present in the fuel vapor system, the monitored pressure may drop at a rapid rate (such as a faster than an expected rate of pressure drop) and/or the pressure may drop to below a threshold pressure (e.g., within a few seconds). For detecting other (e.g., smaller) leaks present in the fuel vapor system, change in positive pressure may have to be monitored for a longer time (e.g., up to a few minutes). At 408, the routine determines if the rate of positive pressure drop is higher than a threshold rate or if the positive pressure has dropped below a threshold pressure. For robust fuel vapor systems, the drop in positive pressure is at a lower rate and within a given time, the positive pressure drops to a certain value which is at or below a threshold pressure value. Consequently, for such cases at 410, the controller indicates that there is no un-latching of connector(s) in the fuel vapor system. Said another way, this also indicates that all the connector systems used in the fuel vapor system are latched and locked in place. If the rate of pressure drop is higher than a threshold rate and/or the pressure drops below the threshold pressure value, it may be inferred that there is a fuel system leak due to un-latching of one or more quick connectors in the fuel vapor system.

At 412, the routine indicates a leak due to un-latching of one or more connector(s) in the fuel vapor system, under application of positive pressure. The indicating includes indicating disconnection of the connector based on a higher than threshold drop in manifold pressure following the application of the positive pressure. In case of the presence of any loosely coupled quick connectors, the positive pressure may first unlatch and then detect the leak caused due to unlatching. At 424, a diagnostic code (flag) may be set to indicate un-latching of the connector based on a higher than expected change in manifold pressure following applying of positive pressure. After the application of positive pressure, the diagnostic process proceeds to apply negative pressure on the system. The negative pressure test is carried out subsequently to confirm the presence of connector un-latching in the system. Also, in case there is no indication of un-latching from the positive pressure test, the negative pressure test is carried out to confirm the outcome.

At 416, vacuum (negative pressure) is applied from the intake manifold to the fuel vapor system. Vacuum is generated in the engine manifold by spinning the engine fueled in the forward direction (same as direction of engine rotation in case of vehicle propulsion). During the generation of vacuum the intake throttle is kept in an open position and the EGR valve, canister purge valve and isolation valve are closed. In this way until the vacuum builds up to a certain value in the intake manifold, the intake manifold is isolated from the fuel vapor system and the EGR system. Once the vacuum reaches a threshold, the canister purge valve and the fuel tank isolation valve are opened to apply vacuum from engine intake manifold to the fuel vapor system.

At 418, after the application of vacuum on the fuel vapor system, the intake manifold pressure (MAP) is monitored using the MAP sensor. During the application and monitoring of vacuum in the fuel vapor system, the canister purge valve and the fuel tank isolation valve are maintained in an open position, while the canister vent valve may be held in closed position. If there is an un-latching of a quick connector in the system, air enters the system through the leak created in the connection and causes a rapid rise in pressure (or in other words, fall in vacuum). In the presence of quick connector unlatching, the rate of rise in pressure is higher than a threshold rate and/or the rise in pressure is to a value higher a threshold pressure.

At 420, the routine determines if the rate of pressure rise is higher than a threshold rate or if the pressure rises higher than a threshold pressure. For a robust fuel vapor system, the rise in pressure is at a lower rate and within a given time it rises to a value that is equal to or lower than a threshold value. If there is no unlatching of quick connectors in the fuel vapor system, at 422, the controller indicates that there is no un-latching of connector(s) in the fuel vapor system. For example, the controller may remove a previously set flag. If there is a connector un-latching in the system (also previously detected by the positive pressure test), the rate of rise in pressure is higher than a threshold and/the pressure rises to higher than a threshold pressure. At 424, the controller confirms the presence of an un-latched connector in the system.

At 426, the diagnostic code (flag) is maintained to indicate un-latching of the connector based on a higher than expected change in manifold pressure following each of the applying of the positive pressure and the negative pressure. The quick connector that has unlatched can then be replaced and/or locked in place by a service technician. The diagnostic code is maintained until an operator input indicative of re-latching of the connector is received. In response to an indication of connector un-latching in the fuel vapor system, at 428, purging of a fuel vapor canister is limited. Therein, in one example, the canister purge valve is held closed and canister purging maintained in a disabled state until re-latching of the un-latched connector is confirmed (such as by the service technician resetting the flag). In another example, a first default maximum purge flow is determined for engine operation during the condition when the flag for fuel vapor system connector un-latching is set. This maximum purge flow may be lower than a second maximum purge flow allowed during regular engine operation with no flag set. In response to the indication of connector un-latching in the fuel vapor system, while operating the vehicle engine, even if a desired purge flow is greater than the first maximum flow, the actual purge flow is limited to the first maximum purge flow (or a lower value). In comparison, when no flag is set (and no un-latched connector in fuel system is detected), purge flow is provided without being limited to the first maximum purge flow. In this way, connector un-latching and leak generation in the fuel vapor system may be diagnosed at the end of assembly line or at a service facility.

Figure 5:
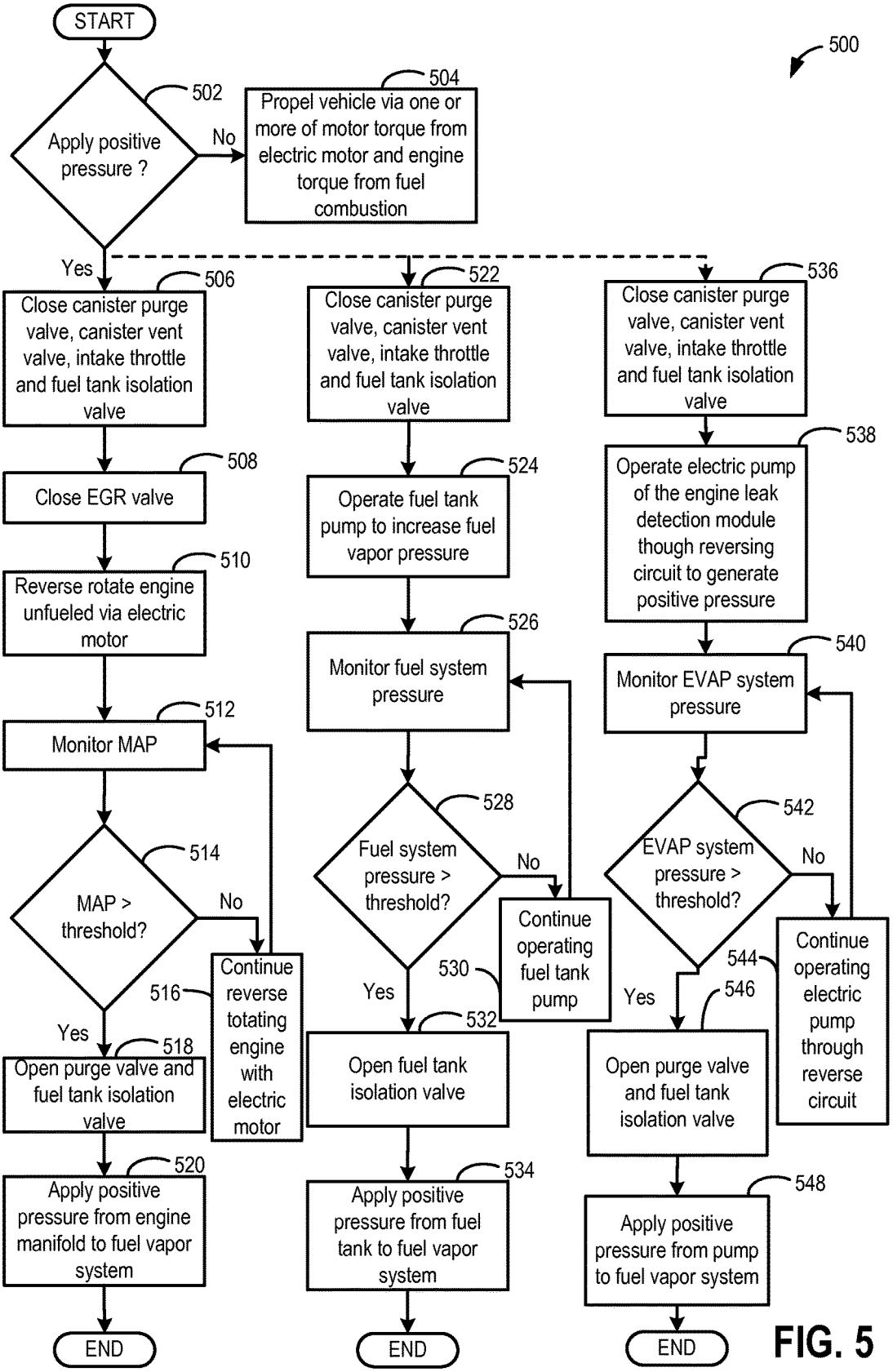
FIG. 5 shows a flow chart illustrating an example method for generating positive pressure for use in diagnosing the unlatching of the quick connector.

FIG. 5 shows an example method for generating positive pressure as used for fuel vapor system diagnostics for detection of unlatched quick connectors. As discussed in relation to FIG. 4, positive pressure is applied to the fuel vapor system to detect any leaks generated due to un-latching of loosely coupled quick connectors in the system.

At 502, the routine includes determining if conditions are met for applying positive pressure for the diagnosis of quick connector un-latching in the fuel vapor system. The positive pressure is required for the diagnostics of quick connector un-latching in a fuel vapor system at the end of assembly line or at a service station. If positive pressure is not required, such as when the vehicle is not in the service mode, the vehicle may be propelled via an electric motor, a fuel combusting engine or a combination of both. As described in relation to FIG. 3, the vehicle may be operated via motor torque from an electric motor, engine torque from a fuel engine or a combination of both motor and engine torque based on operating conditions.

If positive pressure conditions are met, then the positive pressure may be generated via one or more methods. A first example method of positive pressure generation is shown at 506-510. The first method comprises generating positive pressure in the engine intake manifold by reverse rotating an engine. Therein, at 506, prior to positive pressure generation in the intake manifold, the canister purge valve, the canister vent valve, the intake throttle and the fuel tank isolation valve are closed. In this way the intake manifold is isolated from the EVAP and fuel systems, preventing the release of positive pressure during the generation phase. Positive pressure can build up in the intake manifold and can be supplied to the fuel vapor system when the pressure reaches a threshold. During generation of positive pressure in the engine intake manifold, at 508, the EGR valve is closed to prevent positive pressure from escaping the engine intake manifold through the EGR valve.

At 510, the engine is reverse rotated unfueled via an electric motor, thereby generating positive pressure in the intake manifold. Reverse rotation of the engine includes rotating the engine in a direction opposite to the direction of engine rotation for propelling the vehicle. During reverse rotation of the engine, fuel is not used and the engine is spun using motor torque from the electric motor. The increase in positive pressure in the intake manifold is monitored at 512 using a MAP sensor (such as the MAP sensor 224 in FIG. 2) coupled to the intake manifold. With the reverse rotation of the engine, the positive pressure progressively increases in the intake manifold. At 514, the routine determines if the intake positive pressure is higher than a threshold pressure. For effective detection of loosely coupled quick connectors in the fuel system, the positive pressure should be high enough to be able to un-latch such loose connections. Therefore, the threshold pressure may be determined based on a pressure required to un-latch loosely coupled quick connectors. If the intake pressure is below the threshold, at 516, the engine is continued to be reverse rotated by the electric motor to generate sufficient positive pressure.

Once the positive pressure is higher than the threshold pressure, at 518, the canister purge valve and the fuel tank isolation valve are opened. This establishes a fluidic connection between the engine intake manifold and the fuel vapor system. At 520, by opening the fuel system valves, the positive pressure is applied from the intake manifold onto the fuel vapor system as described with relation to FIG. 4

(step 404). Thereafter, as previously detailed at FIG. 4, drop in positive pressure is monitored for detection of un-latched quick connectors in the fuel vapor system. Subsequent to the positive pressure test, a negative pressure test is carried out to confirm the un-latching of the quick connections.

Another example method (herein a second example method) for generating positive pressure for the fuel vapor line diagnostics is shown at 522 of FIG. 5. The second method involves positive fuel vapor pressure generation (in situ) in the fuel system. In the second method, at 522, prior to positive pressure generation in the fuel system, the canister purge valve, the canister vent valve, the intake throttle and the fuel tank isolation valve are closed. In this way the fuel system is isolated from the EVAP system and the intake manifold, preventing the release of positive pressure during the pressure generation phase. Positive pressure may be supplied to the fuel vapor system only after the pressure reaches a threshold.

Once the fuel system has been isolated at 524, the fuel tank pump is operated in order to heat the fuel in the fuel tank to generate fuel vapor pressure. In particular, by operating the fuel pump, fuel in the fuel tank is agitated, resulting in increased fuel vapor generation. In addition, the pump operation generates heat which warms up and evaporates the fuel, producing fuel vapor. The increased fuel vapor generation results in the increase fuel system positive pressure. The increase in fuel pressure is monitored by a fuel tank pressure sensor. Similar to step 514, at 528, the routine determines if the fuel system pressure is higher than a threshold pressure required to be able to un-latch loosely coupled quick connectors in the fuel vapor system. If the intake pressure is below the threshold, at 530, the fuel pump is continued to be operated in order to generate more positive pressure.

Once the positive pressure is higher than the threshold, at 532, the fuel tank isolation valve is opened. This establishes a fluidic connection between the fuel system and the EVAP system. At 534, the positive pressure is applied from the fuel tank in the fuel system onto the complete fuel vapor system as described with relation to FIG. 4 (step 404). Thereafter, a change in fuel system pressure following the application of the positive pressure is monitored by a fuel tank pressure transducer (FTPT) to detect the presence of leaks due to un-latching of loosely coupled connectors in the system, as previously elaborated at FIG. 4. During application of positive pressure from the fuel tank to the complete fuel vapor system, the canister purge valve may be maintained in closed position. Thereby, the fuel vapor system may not be fluidly connected to the MAP sensor and instead of the MAP sensor, the FTPT may be used for monitoring positive pressure in the fuel vapor system.

Another example method (herein a third example method) for generating positive pressure for the fuel vapor line diagnostics is shown at 536 of FIG. 5. The third method involves positive pressure generation using a pump of the engine leak detection module (such as the ELCM pump 298 of FIG. 1). Following the third method, at 536, prior to positive pressure generation in the EVAP system, the canister purge valve, the canister vent valve, the intake throttle and the fuel tank isolation valve are closed. This isolates the EVAP system from the fuel system and the intake manifold. In this way, positive pressure can build up in the EVAP system without being released to the adjoining systems. The positive pressure can be supplied to the complete fuel vapor system once the pressure reaches a threshold.

Once the EVAP system has been isolated at 538, the electric pump is operated in order to generate fuel vapor pressure. An electric pump may be operated to generate vacuum or negative pressure for leak detection routines in the fuel vapor system by using a reference orifice, as previously elaborated in relation to FIG. 2. A reversing circuit may be used to reverse polarize the electric connections in the ELCM pump in order to generate positive pressure using the same pump. In this way, the same pump can be used to generate vacuum for engine-off leak detection routines, as well as quick connector leak diagnostics during a service mode of operation. By using the same pump, component reduction benefits are achieved. The increase in fuel pressure is monitored by a pressure sensor coupled to the EVAP line or a pressure sensor coupled to the fuel vapor canister. Similar to step 514 and 528, at 542, the routine determines if the fuel system pressure is higher than a threshold pressure required for detection of imminent leaks due to unlatching of loosely coupled connections in the fuel vapor system. If the intake pressure is below the threshold, at 544, the electric (ELCM) pump is continued to be operated with the reversing circuit to generate more positive pressure.

Figure 6:
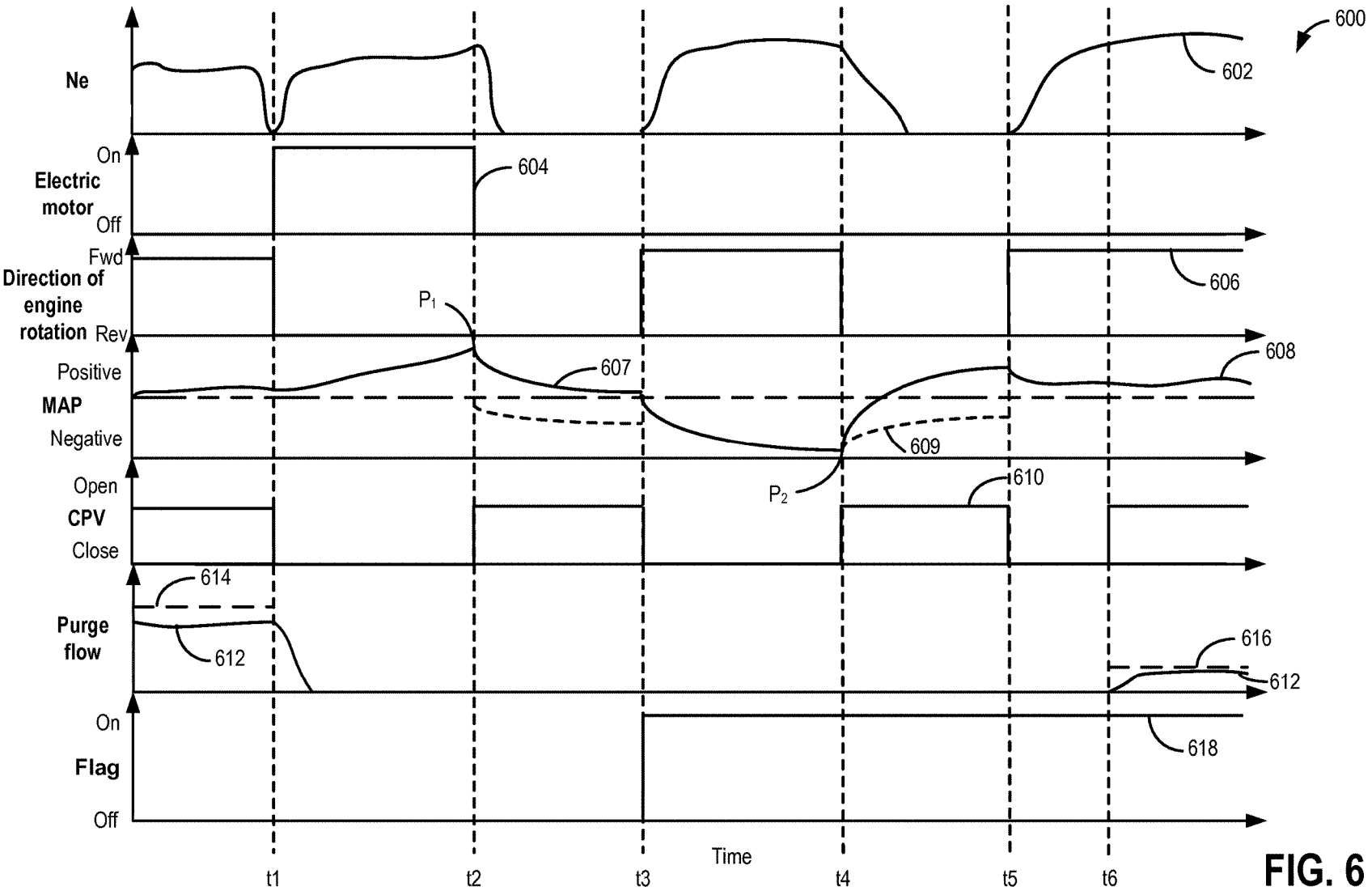
FIG. 6 shows an example of diagnosing a quick connect disconnection in a fuel vapor system based on the sequential application of positive and negative pressure.

Once the positive pressure is higher than the threshold at 546, the canister purge valve and the fuel tank isolation valve are opened to establish fluidic connection between the associated systems. At 548, the positive pressure is applied from the electric pump in the EVAP system onto the complete fuel vapor system (fuel system and EVAP system combined) as described with relation to FIG. 4 (step 404). Thereafter, a change in fuel system pressure following the application of the positive pressure is monitored to detect the presence of fuel system leaks due to un-latching of loosely coupled connectors in the system, as previously elaborated at FIG. 4. In this way positive pressure used for fuel vapor system diagnostics may be generated by one or more of three different techniques. It will be appreciated that in each of the three example methods, existing engine components are used for positive pressure generation. This reduces the need for a dedicated pump, thereby providing component reduction benefits. An engine controller may select one or more methods (such as one or more of the three methods discussed above) for generation of positive pressure based on a combination of parameters. These parameters may include, as non-limiting examples, canister load, fuel tank fill level, battery state of charge (SOC), and ambient temperature. As one example, if the state of charge of a system battery coupled to the electric motor is higher than a threshold charge, the electric motor may be operated to rotate the engine in the reverse direction for positive pressure generation. If the SOC is lower than a first threshold, the controller may select between positive pressure generation via operation of the fuel pump or the ELCM pump based on a fill level of the fuel tank or ambient temperature. If the SOC is lower than a second threshold, the controller may be limited to using any pre-existing positive pressure in a sealed fuel tank (this method requires least use of energy). For example, operation of the fuel pump may be selected when the fill level is higher than a threshold or when ambient temperature is lower than a threshold. In this way, based on engine operating conditions and conditions relating to the electric motor, the fuel system and the EVAP system, one or more suitable method(s) for positive pressure generation may be selected. FIG. 6 shows an example operating sequence 600 illustrating diagnosis of a quick connector disconnection in a fuel vapor system coupled in a hybrid electric vehicle. The diagnostic method comprises sequentially applying positive pressure from an engine intake manifold and then vacuum from the engine intake manifold on a fuel vapor system;

monitoring a manifold pressure (MAP) response following each of the applying positive pressure and vacuum; and indicating un-latching of a connector coupled to a fuel vapor system conduit based on the MAP response. The horizontal (x-axis) denotes time and the vertical markers t1-t6 identify significant times in the quick connector un-latching diagnosis.

The first plot (line 602) from top shows change in engine speed (Ne) over time. The second plot (line 604) indicates operation of an electric motor of the hybrid electric vehicle. When the plot shows the ON position, the electric motor is operated and when the plot shows the OFF position, the electric motor is not in use. The third plot (line 606) shows a direction of rotation of the engine. The engine may be rotated forward for vehicle propulsion using fuel or it may be reverse rotated unfueled using the electric motor. The fourth plot (line 608) shows the variation in intake manifold pressure, as measured by a MAP sensor, with time. The intake manifold pressure may be positive or negative depending on vehicle operation. In this example, the highest positive pressure measured by MAP sensor is denoted by $P_1$ and the lowest negative pressure measured by MAP sensor is denoted by $P_2$. The fifth plot (line 610) shows the position of a canister purge valve (CPV) in the EVAP system The CPV may either be open or closed depending on vehicle operation. The sixth plot (line 612) shows canister purge flow into the engine from the evaporative emission control (EVAP) system. In this example, lines 614 and 616 show a first and second maximum permissible purge flows depending on operating conditions. The final, seventh plot (line 618) indicates a flag (diagnostic code) to show the presence of any un-latched connections in the fuel vapor system.

Prior to time t1, the vehicle is operated in the engine mode where fuel is combusted in the engine and the vehicle is propelled using engine torque. During this phase, the engine is rotated in the forward direction and the engine speed varies with time depending on engine load. As the vehicle is operated purely in engine mode, the electric motor is in OFF state. The intake manifold pressure varies with engine operating conditions. The canister purge valve (CPV) is kept open as the engine speed is high enough and the canister purging conditions are met during this period. The purge flow varies with time depending on engine speed. In this example, the purge flow prior to time t1, is close to the maximum permissible purge flow 614 for the given engine operating conditions. The diagnostics of the fuel vapor system to detect leakages due to quick connector disconnection is not carried out during this phase and the flag is kept in an OFF position.

At time t1, a service tool is attached to the vehicle by an operator through a port, either at the end of assembly line or at a service station. At this point, the vehicle operating mode is switched from engine mode to service mode and diagnostics are carried out for detection of loosely coupled connectors in the fuel vapor system. After time t1, the engine is rotated unfueled in the reverse direction via the motor. Specifically, the engine is rotated in a direction opposite to the direction of engine rotation during vehicle propulsion.

At t1, as the vehicle operation transitions from engine mode (using fuel combustion for engine rotation) to service mode (using electric motor for engine reverse rotation), the engine speed reduces to zero. At this point the engine is not rotated in either forward or reverse direction. Once the unfueled reverse rotation of the engine starts, the engine speed increases (line 602) and stabilizes over time.

Due to engine reverse rotation, positive pressure builds up in the intake manifold. In order to isolate the intake manifold from the fuel vapor system during the generation of positive pressure, the CPV is kept closed. This ensures that the positive pressure generated does not spread to the fuel vapor system before a pressure threshold is reached. The positive intake manifold pressure increases with time as seen from line 608 and the increase is continually monitored using a MAP sensor. For effective detection of loosely coupled fuel vapor system quick connectors, the positive pressure needs to be high enough to be able to un-latch such connectors. The engine is reverse rotated until the positive intake manifold pressure reaches a threshold pressure $P_1$, at time t2. The threshold pressure $P_1$ is determined based on the pressure required to un-latch loosely coupled quick connectors. During the time period t1 to t2 the diagnosis for detection of the loosely coupled connectors has not been concluded, therefore the Flag is maintained in the OFF position.

At time t2, the positive MAP reaches a threshold pressure $P_1$ and this positive pressure is applied to the fuel vapor system by opening the CPV and the fuel tank isolation valve. Once the positive pressure reaches is applied to the fuel vapor system, further generation of positive pressure is not required. Hence at t2, the electric motor is turned OFF and the engine reverse rotation is ended. In other words, after t2, the engine is not rotated unfueled or fueled. Consequently, after t2, once engine rotation is stopped, the engine speed reduces to zero.

Between time t2 and t3, a change in fuel vapor system pressure following the application of the positive pressure is monitored. In the depicted example, a drop in fuel system pressure (towards atmospheric pressure) is monitored using a MAP sensor. In order to maintain fluidic connection between the fuel vapor system and the MAP sensor, the CPV is maintained in the open position throughout the monitoring of pressure between t2 and t3. In the presence of one or more loosely coupled connectors, the positive pressure applied to the fuel vapor system unlatches, causing a leak. In such a case, the positive pressure may drop at a rapid rate as shown by the solid line 608 between time t2 and t3 and the pressure may finally stabilize at a lower pressure value (e.g., below a threshold value). The rate of pressure drop is compared to a threshold rate and/or the value for stabilization of pressure is compared to a threshold pressure. In the absence of a leak, the fuel tank pressure may drop at a slower rate (e.g., slower than a threshold rate), and stabilize at a higher pressure value (e.g., at or above a threshold pressure), as shown by dotted line 607. Therefore, if the rate of pressure drop is higher than the threshold rate and/or if the pressure drops to below a threshold pressure value, it may be inferred that there is un-latching of one or more quick connectors in the fuel vapor system. This inference is subsequently confirmed by the application of negative pressure.

At t3, the positive pressure test for detection of fuel vapor system leaks due to quick connector unlatching is completed. If un-latching of one or more quick connector(s) in the fuel vapor system is detected following a positive pressure test, a flag (diagnostic code) may be set, as indicated by the position of line 618. In this way positive pressure may be initially used to detect leaks in the fuel vapor system caused by un-latching of loosely coupled quick connectors.

At t3, immediately after the conclusion of the positive pressure test, a negative pressure test is initiated. For generating the negative pressure, the engine is rotated, fueled, in the forward direction. This is the direction of engine rotation for vehicle propulsion. Since fuel is use for engine rotation during this time period (between t3 and t4), the electric motor is maintained in OFF state. With the forward rotation of engine, the engine speed (line 602) increases until it stabilizes. Due to the forward rotation of engine, negative pressure is generated in the intake manifold. Similar to the case for positive pressure, in order to isolate the intake manifold during the generation of negative pressure, the CPV is kept closed. This ensures that the negative pressure generated via engine rotation does not spread to the fuel vapor system before a negative pressure threshold is reached. The negative intake manifold pressure (or vacuum) increases (in the negative direction) with time as seen from line 608 and the increase is continually monitored using a MAP sensor. The engine is forward rotated until the negative intake manifold pressure reaches a lower threshold pressure threshold $P_2$, at time t4. The lower threshold pressure $P_2$ is determined based on the pressure required to confirm the presence of un-latched loosely connections in the fuel vapor system. During the time period t3 to t4, due to the presence of un-latched loosely connections in the fuel vapor system (as detected by the positive pressure test) the flag is maintained in the ON position.

At time t4, the negative MAP reaches a lower threshold pressure $P_2$ and this negative pressure is applied to the fuel vapor system by opening the CPV and the fuel tank isolation valve. Once the negative pressure reaches the threshold $P_2$ and is applied to the fuel vapor system, further generation of negative pressure is not required. Hence at t4, forward engine rotation is ended. After time t4, the engine is not rotated unfueled or fueled and the electric motor is maintained in OFF position. After t4, once engine rotation is stopped, the engine speed reduces to zero. After the negative pressure $P_2$ is applied to the fuel vapor system, between time t4 and t5, a change in fuel vapor system pressure following the application of the negative pressure is monitored. In the depicted example, rise in fuel system pressure (towards atmospheric pressure) is monitored using a MAP sensor. After the opening of CPV at t4, in order to maintain fluidic connection between the fuel vapor system and the MAP sensor, the CPV is maintained in the open position throughout the monitoring of pressure between t4 and t5. In case of presence of a leak caused by un-latching of a loosely coupled connector, the negative pressure may rise at a faster rate as shown by the solid line 608 between time t4 and t5 and the pressure may stabilize at a higher pressure value (e.g., above a threshold value). The rate of pressure rise is compared to a threshold rate and/or the value for stabilization of pressure is compared to a threshold pressure. As such, the negative pressure test is performed even if no leak due to quick connect un-latching was detected by the positive pressure test. In the absence of a leak, the fuel tank pressure may rise at a slower rate (e.g., slower than a threshold rate), and stabilize at a lower pressure value (e.g., at or above a reference value), as shown by dotted line 609. Therefore, if the rate of pressure drop is higher than a threshold rate and/or if the pressure rises to a value above a threshold pressure, it may be confirmed that there is un-latching of one or more connectors in the fuel vapor system. At t5, the negative pressure test for detection of fuel vapor system leaks due to connector un-latching is completed. If un-latching of one or more quick connector(s) in the fuel vapor system is confirmed following both the positive and the negative pressure test, the flag (diagnostic code) is continued to be set (in ON position).

After time t5, on completion of the diagnostic process, the service tool may be detached from the vehicle by the operator and the vehicle may operate in the fueled engine mode. In another example, the vehicle may be operated in the electric or assist mode depending on operating conditions. Fuel is used for rotating the engine in the forward direction while the electric motor is maintained in the OFF position. Post t5, as the engine is rotated in the forward direction, the engine speed varies with time depending on engine load. The intake manifold pressure varies with engine operating conditions. Until the re-latching of the un-latched connector(s) is indicated, the flag (diagnostic code) is maintained set.

After the detection of an un-latching of one or more connectors(s) in the fuel vapor system at t5, the CPV is regulated to limit purging of fuel vapor canister until an operator indicates re-latching of the un-latched connector(s). In other words, canister purging is limited in response to the indication of quick connector un-latching even if canister purging conditions are met. As such, this reduces the unwanted emission of fuel vapors into the atmosphere. In this example, between time t5 and t6, the engine speed is low and the canister purging conditions are not met. Therefore, at time t5, the CPV is closed and is maintained in closed state during the time period between t5 and t6.

At time t6, the engine speed is once again high enough to meet canister purging conditions. However at this stage, due to the flag being set following the detection of quick connector un-latching in the fuel system, purging canister purge flow is limited. In particular, a maximum permissible purge flow 618 is set to be lower than the maximum permissible purge flow 614 allowed when the flag is not set. It will be appreciated that, as such, even though the desired canister purge flow requested at t6 (based on operating conditions) is higher than maximum permissible purge flow 618, the canister purge flow is actively limited to or within maximum permissible purge flow 618. At time t6, the CPV is accordingly opened and limited canister purging is carried out with purge flow 612 equal to the maximum (lower) permissible purge flow 618. The limitation on purging is maintained until re-latching of the un-latched connector(s) is confirmed (such as by a service technician resetting the flag). In response to an indication of re-latching, the maximum purge flow is raised to the higher level. After t6, the engine is continued to be forward rotated by use of fuel while the electric motor is maintained in the OFF position. The intake manifold pressure varies based on engine operating conditions. In this way, positive and negative pressure may be used at end of assembly line and/or at service stations to detect leaks in the fuel vapor system caused by un-latching of loosely coupled connectors.

One example method for diagnosing fuel vapor system leaks due to disconnections in interfaces of a fuel vapor system comprises reverse rotating an engine unfueled and opening a purge valve to apply positive pressure from an intake manifold on a fuel vapor system; and indicating disconnection of a connector coupled to a fuel vapor conduit of the fuel vapor system based on a pressure response following the application of positive pressure. The preceding example further comprises in response to the indicating, limiting purging of a fuel vapor canister until an operator input indicative of connector recoupling is received. In any or all of the preceding examples, additionally or optionally, reverse rotating the engine unfueled and opening the purge valve includes initially reverse rotating the engine unfueled with the purge valve closed until intake manifold pressure is higher than a threshold, and then opening the purge valve to apply the higher that threshold intake manifold pressure on the fuel vapor system, wherein the reverse rotating includes rotating the engine in a direction opposite to the direction of engine rotation for propelling the vehicle. In any or all of the preceding examples, additionally or optionally, the engine is coupled in a hybrid electric vehicle including an electric motor, and spinning the engine unfueled includes spinning the engine via the electric motor. In any or all of the preceding examples, additionally or optionally, the reverse rotating is in response to coupling of a service tool to the engine by an operator. In any or all of the preceding examples, indicating additionally or optionally includes indicating imminent disconnection of the connector based on a higher than threshold drop in manifold pressure following the application of the positive pressure. In any or all of the preceding examples, additionally or optionally, during the reverse rotating, an engine intake throttle is held closed and an EGR valve is held closed. Any or all of the preceding examples, additionally or optionally further comprise, in response to the indicating, forward rotating the engine fueled with the purge valve open to apply negative pressure from the intake manifold on the fuel vapor system and confirming disconnection of the connector based on the pressure response following the application of negative pressure. In any or all of the preceding examples, additionally or optionally while forward rotating the engine, the intake throttle is held open and the EGR valve is closed. In any or all of the preceding examples, additionally or optionally, the purge valve is open during the application of negative pressure, and the pressure response is observed while the purge valve is held open.

Another example method for diagnosing fuel vapor system leaks due to disconnections in interfaces of a fuel vapor system comprises sequentially applying positive pressure from an engine and then vacuum from the engine on a fuel vapor system; monitoring a manifold pressure (MAP) response following each of the applying positive pressure and vacuum; and indicating un-latching of a connector coupled to a fuel vapor system conduit based on the MAP response. In the preceding example applying positive pressure on the fuel vapor system includes maintaining each of a canister purge valve, a canister vent valve, and a fuel tank isolation valve closed until the positive pressure at the engine is higher than a threshold pressure, and then selectively opening the purge valve and the fuel tank isolation valve to apply the positive pressure on the fuel vapor system. In any or all of the preceding examples, additionally or optionally, applying vacuum from the engine on the fuel vapor system includes closing each of the canister purge valve, canister vent valve, and fuel tank isolation valve closed until the vacuum at the engine is higher than a threshold vacuum, and then selectively opening the purge valve and the fuel tank isolation valve to apply the vacuum on the fuel vapor system. In any or all of the preceding examples, additionally or optionally, applying positive pressure from the engine on the fuel vapor system includes one of reverse rotating the engine unfueled via an electric motor with an intake throttle closed and an EGR valve closed to apply positive intake manifold pressure, using a pre-existing fuel tank pressure, operating a fuel tank pump to apply positive fuel vapor pressure, and operating an electric pump of an engine leak detection module with a reversing circuit to apply positive air pressure. In any or all of the preceding examples, additionally or optionally, applying vacuum from the engine on the fuel vapor system includes spinning the engine fueled with the intake throttle open and the EGR valve closed, and further with the canister purge valve, and fuel tank isolation valve open to apply engine intake vacuum on the fuel vapor system. In any or all of the preceding examples, additionally or optionally, indicating based on the MAP response includes indicating un-latching of the connector in response to a higher than threshold change in manifold pressure following each of the applying positive pressure and vacuum. Any or all of the preceding examples, additionally or optionally further comprise, in response to the indicating, limiting purging of a fuel vapor canister to a first purge flow threshold, lower than a second purge flow threshold applied when there is no indicating of un-latching of the connector, the limited canister purging maintained until an operator input indicative of re-latching of the un-latched connector is received.

One example hybrid vehicle system comprises vehicle wheels propelled via one or more of an engine and an electric motor; an engine intake manifold including an intake throttle; a pressure sensor coupled to the engine intake manifold for estimating a manifold pressure; a fuel vapor system including a fuel tank coupled to a canister, a fuel vapor conduit, and a quick-disconnect connector coupled to the fuel vapor conduit; a canister purge valve coupling the canister to the engine intake manifold; an isolation valve coupling the canister to the fuel tank; a port for receiving a diagnostic tool; and a controller. The controller may be configured with computer readable instructions stored on non-transitory memory for: in response to coupling of the diagnostic tool to the port, transitioning the engine to a service mode to initially apply positive pressure from the intake manifold on the fuel vapor system via reverse engine rotation and subsequently apply negative pressure from the intake manifold on the fuel vapor system via forward engine rotation; and setting a diagnostic code to indicate un-latching of the connector based on a higher than expected change in manifold pressure following each of the applying of the positive pressure and the negative pressure, the diagnostic code set until an operator input indicative of reconnecting of the connector is received. In preceding example, additionally or optionally, applying the positive pressure includes reverse rotating the engine, unfueled, via the electric motor with the canister purge valve, isolation valve, and the intake throttle closed until the manifold pressure is higher than a threshold positive pressure and then opening the purge valve and the isolation valve to apply the manifold pressure on the fuel vapor system; wherein applying the negative pressure includes spinning the engine, fueled, with the canister purge valve, and isolation valve closed until the manifold pressure is lower than a threshold negative pressure and then opening the purge valve and the isolation valve to apply the manifold pressure on the fuel vapor system. In any or all of the preceding examples, additionally or optionally, the controller includes further instructions for: while the diagnostic code is set, in response to canister purging conditions being met, opening the canister purge valve by a smaller amount to purge the canister at a first, lower level; and when the diagnostic code is reset, in response to canister purging conditions being met, opening the canister purge valve by a larger amount to purge the canister at a second, higher level.

In this way any present or imminent un-latching of connectors in a fuel vapor system may be detected at end of assembly line and/or at a service station. Positive and negative pressure may be applied successively to detect and confirm any leaks caused by un-latching of quick connectors in the fuel vapor system. By enabling early detection of imminent un-latching of quick connectors, occurrences of leaks during vehicle on-road operation may be significantly reduced. The technical effect of diagnosing for leaks by sequentially applying positive pressure followed by negative pressure is that leaks due to loose coupling of quick connectors may be detected. By first applying positive pressure, any loosely coupled quick connector may be completely unlatched, reducing their false passing of negative pressure leak tests. In particular, false negative leak test results caused due to loosely coupled quick connectors becoming temporarily pulled together during vacuum application is reduced. By generating positive pressure for the detection of un-latched quick connectors using existing engine components (such as existing motors and pumps), component and cost reduction benefits are provided. In this way, by improving the reliability of early detection of fuel system leaks due to un-latching of fuel system quick connectors, fuel system integrity can be better ensured and early warranty issues may be reduced. In addition, emissions compliance may be improved.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

reverse rotating an engine unfueled in a direction opposite to a direction of engine rotation for vehicle propulsion and opening a purge valve to apply positive pressure, generated via the reverse rotating, from an intake manifold on a fuel vapor system; and indicating disconnection of a connector coupled to a fuel vapor conduit of the fuel vapor system based on a pressure response following application of the positive pressure.

2. The method of claim 1, further comprising, in response to the indicating, limiting purging of a fuel vapor canister until an operator input indicative of connector recoupling is received.

3. The method of claim 1, wherein reverse rotating the engine unfueled and opening the purge valve includes initially reverse rotating the engine unfueled with the purge valve closed until intake manifold pressure is higher than a threshold, and then opening the purge valve to apply the higher than threshold intake manifold pressure on the fuel vapor system.

4. The method of claim 1, wherein the indicating includes indicating imminent disconnection of the connector based on a higher than threshold drop in manifold pressure following the application of the positive pressure.

5. The method of claim 1, wherein the engine is coupled in a hybrid electric vehicle including an electric motor, and wherein spinning the engine unfueled includes spinning the engine via the electric motor.

6. The method of claim 1, further comprising, during the reverse rotating, holding an engine intake throttle closed.

7. The method of claim 6, further comprising, during the reverse rotating, holding an EGR valve closed.

8. The method of claim 7, further comprising, in response to the indicating, forward rotating the engine fueled with the purge valve open to apply negative pressure from the intake manifold on the fuel vapor system and confirming disconnection of the connector based on the pressure response following the application of negative pressure.

9. The method of claim 8, further comprising, while forward rotating the engine, holding the intake throttle open and the EGR valve closed.

10. The method of claim 8, wherein the purge valve is open during the application of negative pressure, and the pressure response is observed while the purge valve is held open.

11. The method of claim 1, wherein the reverse rotating is in response to coupling of a service tool to the engine by an operator.

12. A method for an engine, comprising:

sequentially applying positive pressure from an engine and then vacuum from the engine on a fuel vapor system;

monitoring a manifold pressure (MAP) response following each of the applying positive pressure and vacuum; and indicating un-latching of a connector coupled to a fuel vapor system conduit based on the MAP response, including indicating un-latching of the connector in response to a higher than threshold change in manifold pressure following each of the applying positive pressure and vacuum.

13. The method of claim 12, wherein applying positive pressure on the fuel vapor system includes maintaining each of a canister purge valve, a canister vent valve, and a fuel tank isolation valve closed until the positive pressure at the engine is higher than a threshold pressure, and then selectively opening the canister purge valve and the fuel tank isolation valve to apply the positive pressure on the fuel vapor system, and wherein applying vacuum from the engine on the fuel vapor system includes closing each of the canister purge valve, canister vent valve, and fuel tank isolation valve closed until the vacuum at the engine is higher than a threshold vacuum, and then selectively opening the canister purge valve and the fuel tank isolation valve to apply the vacuum on the fuel vapor system.

14. The method of claim 12, wherein applying positive pressure from the engine on the fuel vapor system includes one of reverse rotating the engine unfueled via an electric motor with an intake throttle closed and an EGR valve closed to apply positive intake manifold pressure, using a pre-existing fuel tank pressure, operating a fuel tank pump to apply positive fuel vapor pressure, and operating an electric pump of an engine leak detection module with a reversing circuit to apply positive air pressure.

15. The method of claim 14, wherein applying vacuum from the engine on the fuel vapor system includes spinning the engine fueled with the intake throttle open and the EGR valve closed, and further with a canister purge valve and fuel tank isolation valve open to apply engine intake vacuum on the fuel vapor system.

16. The method of claim 12, further comprising, in response to the indicating, limiting purging of a fuel vapor canister to a first purge flow threshold, lower than a second purge flow threshold applied when there is no indicating of un-latching of the connector, the limited canister purging maintained until an operator input indicative of re-latching of the un-latched connector is received.

17. A hybrid vehicle system, comprising:

vehicle wheels propelled via one or more of an engine and an electric motor;

an engine intake manifold including an intake throttle;

a pressure sensor coupled to the engine intake manifold for estimating a manifold pressure;

a fuel vapor system including a fuel tank coupled to a canister, a fuel vapor conduit, and a quick-disconnect connector coupled to the fuel vapor conduit;

a canister purge valve coupling the canister to the engine intake manifold;

an isolation valve coupling the canister to the fuel tank;

a port for receiving a diagnostic tool; and a controller with computer readable instructions stored on non-transitory memory for:

in response to coupling of the diagnostic tool to the port, transitioning the engine to a service mode to initially apply positive pressure from the intake manifold on the fuel vapor system via reverse engine rotation and subsequently apply negative pressure from the intake manifold on the fuel vapor system via forward engine rotation; and setting a diagnostic code to indicate un-latching of the connector based on a higher than expected change in manifold pressure following each of the applying of the positive pressure and the negative pressure, the diagnostic code set until an operator input indicative of reconnecting of the connector is received.

18. The system of claim 17, wherein applying the positive pressure includes reverse rotating the engine, unfueled, via the electric motor with the canister purge valve, the isolation valve, and the intake throttle closed until the manifold pressure is higher than a threshold positive pressure and then opening the canister purge valve and the isolation valve to apply the manifold pressure on the fuel vapor system; and wherein applying the negative pressure includes spinning the engine, fueled, with the canister purge valve and isolation valve closed until the manifold pressure is lower than a threshold negative pressure and then opening the canister purge valve and the isolation valve to apply the manifold pressure on the fuel vapor system.

19. The system of claim 17, wherein the controller includes further instructions for:

while the diagnostic code is set, in response to canister purging conditions being met, opening the canister purge valve by a smaller amount to purge the canister at a first, lower level; and when the diagnostic code is reset, in response to canister purging conditions being met, opening the canister purge valve by a larger amount to purge the canister at a second, higher level.

* * * * *